US007375272B2

(12) United States Patent
Wang

(10) Patent No.: US 7,375,272 B2
(45) Date of Patent: May 20, 2008

(54) PEDAL STAND FOR MUSICAL INSTRUMENT

(76) Inventor: Wei-Pin Wang, 58, Ma Yuan West St., Taichung (TW)

( * ) Notice: Subject to any disclaimer, the term of this patent is extended or adjusted under 35 U.S.C. 154(b) by 0 days.

(21) Appl. No.: 11/506,481

(22) Filed: Aug. 21, 2006

(65) Prior Publication Data

US 2008/0041216 A1 Feb. 21, 2008

(51) Int. Cl.
*G10D 13/02* (2006.01)

(52) U.S. Cl. ..... 84/426; 84/422.1
(58) Field of Classification Search ..... 84/422.1, 84/422.2, 422.3, 426

See application file for complete search history.

(56) References Cited

U.S. PATENT DOCUMENTS 6,188,007 B1 * 2/2001 Liao ..... 84/422.3

* cited by examiner

*Primary Examiner*—Kimberly Lockett
(74) *Attorney, Agent, or Firm*—Alan Kamrath; Kamrath & Associates PA

(57) ABSTRACT

A pedal stand for a musical instrument includes a main frame, a support rack foldably mounted on the main frame, and a locking device mounted between the main frame and the support rack to detachably lock the support rack on the main frame. Thus, when the push button of the locking device is pushed downward, the support rack is unlocked from the locking device and is pivotable relative to the main frame to fold the pedal stand, so that the pedal stand is folded easily and quickly. In addition, the user only needs to push the push button to fold the pedal stand, so that the pedal stand is folded in an energy-saving manner, thereby facilitating the user folding the pedal stand.

18 Claims, 4 Drawing Sheets

PEDAL STAND FOR MUSICAL INSTRUMENT

BACKGROUND OF THE INVENTION

1. Field of the Invention

The present invention relates to a pedal stand and, more particularly, to a pedal stand for a musical instrument, such as a cymbal, tom-tom, drum and the like.

2. Description of the Related Art

A conventional pedal stand 1 for a musical instrument in accordance with the prior art shown in FIG. 6 comprises a main frame 12, a support rack 11 foldably mounted on the main frame 12 by two screw members 14, and a pedal 16 pivotally mounted on the support rack 11. Thus, when the screw members 14 are tightened, the support rack 11 is fixed to the main frame 12, so that the pedal stand 1 is fully expanded for use with a user, and when the screw members 14 are loosened, the support rack 11 is pivotable upward relative to the main frame 12 to fold the pedal stand 1, so that the pedal stand 1 is folded when not in use. However, the user has to tighten the screw members to expand the pedal stand 1 and to loosen the screw members to fold the pedal stand 1, thereby causing inconvenience to the user, and thereby wasting the user's energy and time.

BRIEF SUMMARY OF THE INVENTION

In accordance with the present invention, there is provided a pedal stand, comprising a main frame, a support rack foldably mounted on the main frame, a pedal pivotally mounted on the support rack, and a locking device mounted between the main frame and the support rack to detachably lock the support rack on the main frame.

The primary objective of the present invention is to provide a pedal stand that is folded and expanded easily and quickly.

Another objective of the present invention is to provide a pedal stand, wherein when the push button of the locking device is pushed downward, the support rack is unlocked from the locking device and is pivotable relative to the main frame to fold the pedal stand, so that the pedal stand is folded easily and quickly.

A further objective of the present invention is to provide a pedal stand, wherein the user only needs to push the push button to fold the pedal stand, so that the pedal stand is folded in an energy-saving manner, thereby facilitating the user folding the pedal stand.

A further objective of the present invention is to provide a pedal stand, wherein each of the catch portions of the movable member is locked onto the respective locking hook of the support rack at the normal state, so that the support rack is locked by the locking device closely and exactly, and the pedal stand is positioned rigidly and stably.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
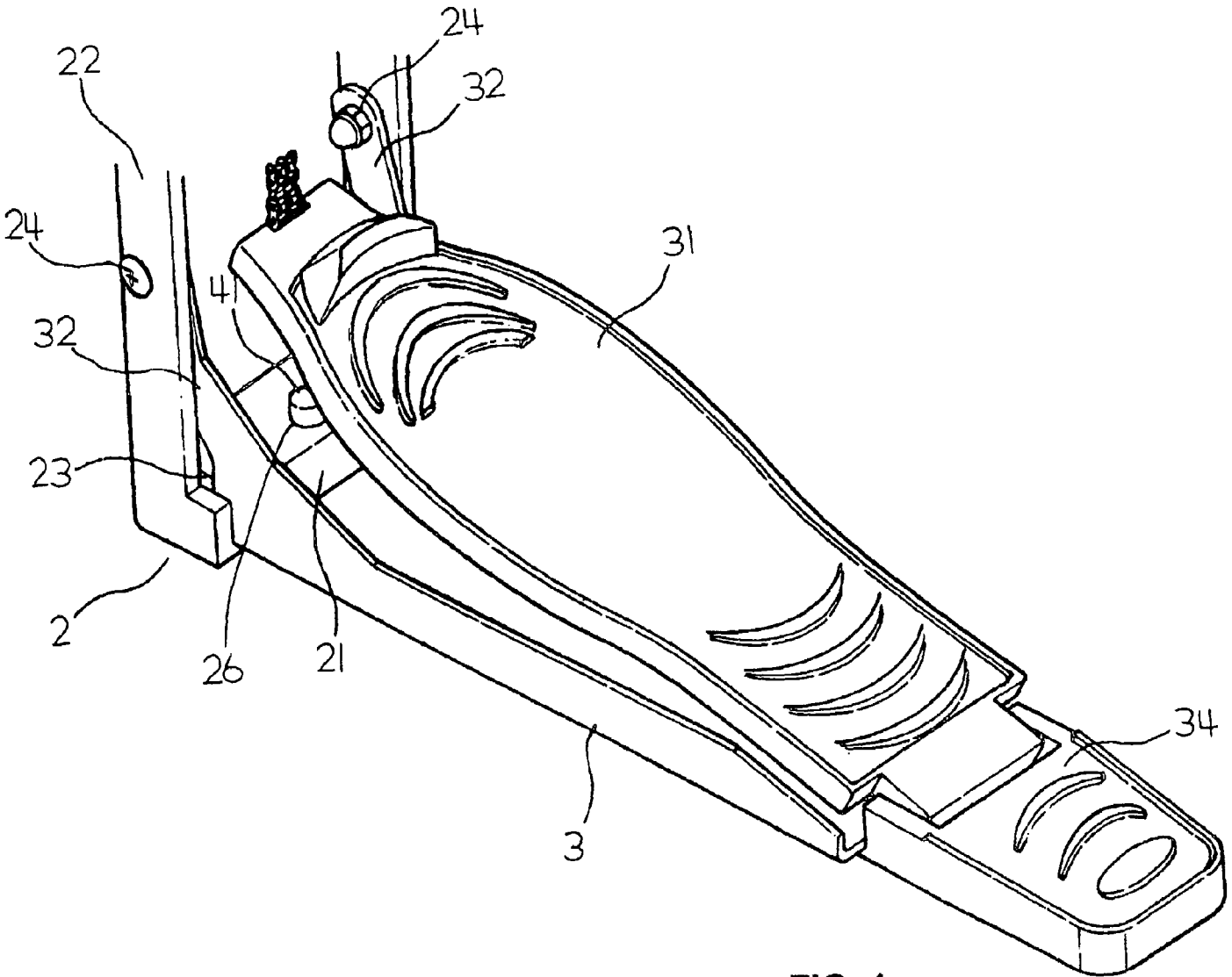
FIG. 1 is a partially perspective view of a pedal stand in accordance with the preferred embodiment of the present invention.
Figure 2:
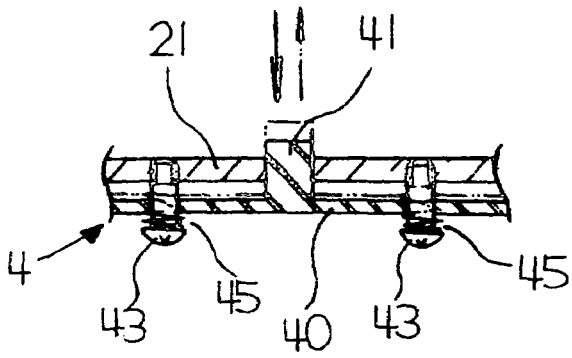
FIG. 2 is a partially plan cross-sectional view of the pedal stand as shown in FIG. 1.

Referring to the drawings and initially to FIGS. 1-4, a pedal stand for a musical instrument in accordance with the preferred embodiment of the present invention comprises a main frame 2, a support rack 3 foldably mounted on the main frame 2, a pedal 31 pivotally mounted on the support rack 3, and a locking device 4 mounted between the main frame 2 and the support rack 3 to detachably lock the support rack 3 on the main frame 2.

Thus, the locking device 4 is operable between a first position where the support rack 3 is locked by the locking device 4, so that the support rack 3 is not pivotable relative to the main frame 2 and a second position where the support rack 3 is unlocked from the locking device 4, so that the support rack 3 is pivotable relative to the main frame 2.

The main frame 2 includes an upright support portion 22 and a horizontal fixing portion 21 mounted on a lower portion of the support portion 22. The fixing portion 21 of the main frame 2 has two sides each formed with a breach 23 located at a connection of the fixing portion 21 and the support portion 22. The fixing portion 21 of the main frame 2 has a hollow inside and has a top having a mediate portion formed with a through hole 26.

The support rack 3 has a substantially L-shaped cross-sectional profile and has a first end 32 pivotally mounted on the support portion 22 of the main frame 2 by two screw members 24, a mediate portion formed with two locking hooks 33 each movably mounted in the respective breach 23 of the fixing portion 21 of the main frame 2 and a second end 34 for pivoting the pedal 31. The support portion 22 of the main frame 2 is formed with two pivot holes 220 (see FIG. 5) to allow passage of the respective screw member 24.

The locking device 4 includes a movable member 40 movably mounted in the fixing portion 21 of the main frame 2 and formed with two protruding catch portions 42 each detachably locked onto the respective locking hook 33 of the support rack 3, a push button 41 mounted on a first side of the movable member 40 and protruded outwardly from the through hole 26 of the fixing portion 21 of the main frame 2, two fastening bolts 43 each extended through the movable member 40 and the fixing portion 21 of the main frame 2, and two elastic members 45 each mounted on the respective fastening bolts 43 and each biased between the respective fastening bolts 43 and a second side of the movable member 40 to push the movable member 40 toward the top of the fixing portion 21 of the main frame 2 and the support rack 3 so that each of the two catch portions 42 of the movable member 40 is locked onto the respective locking hook 33 of the support rack 3 at a normal state.

Each of the two catch portions 42 of the movable member 40 has a first side formed with a limit ramp 422 rested on the respective locking hook 33 of the support rack 3 and a second side formed with a guide ramp 421 juxtaposed to the limit ramp 422. The limit ramp 422 of each of the two catch portions 42 of the movable member 40 has an oblique direction facing that of the respective locking hook 33 of the support rack 3, and the guide ramp 421 of each of the two catch portions 42 of the movable member 40 has an oblique direction different from that of the limit ramp 422 and has an inclined angle smaller than that of the limit ramp 422.

Figure 3:
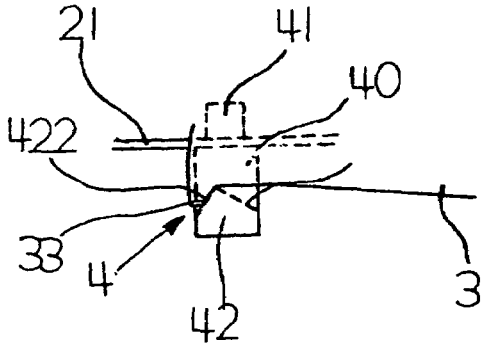
FIG. 3 is a partially plan cross-sectional view of the pedal stand as shown in FIG. 1.
Figure 4:
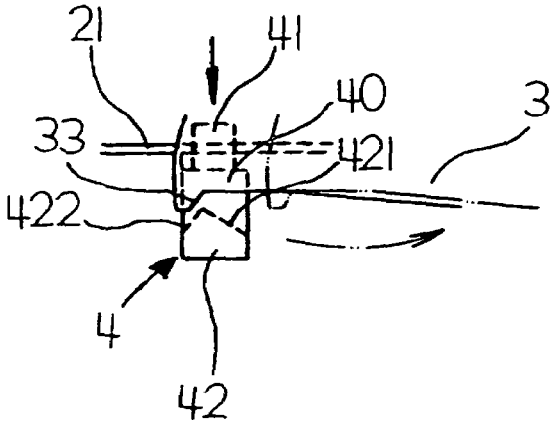
FIG. 4 is a schematic operational view of the pedal stand as shown in FIG. 3.
Figure 5:
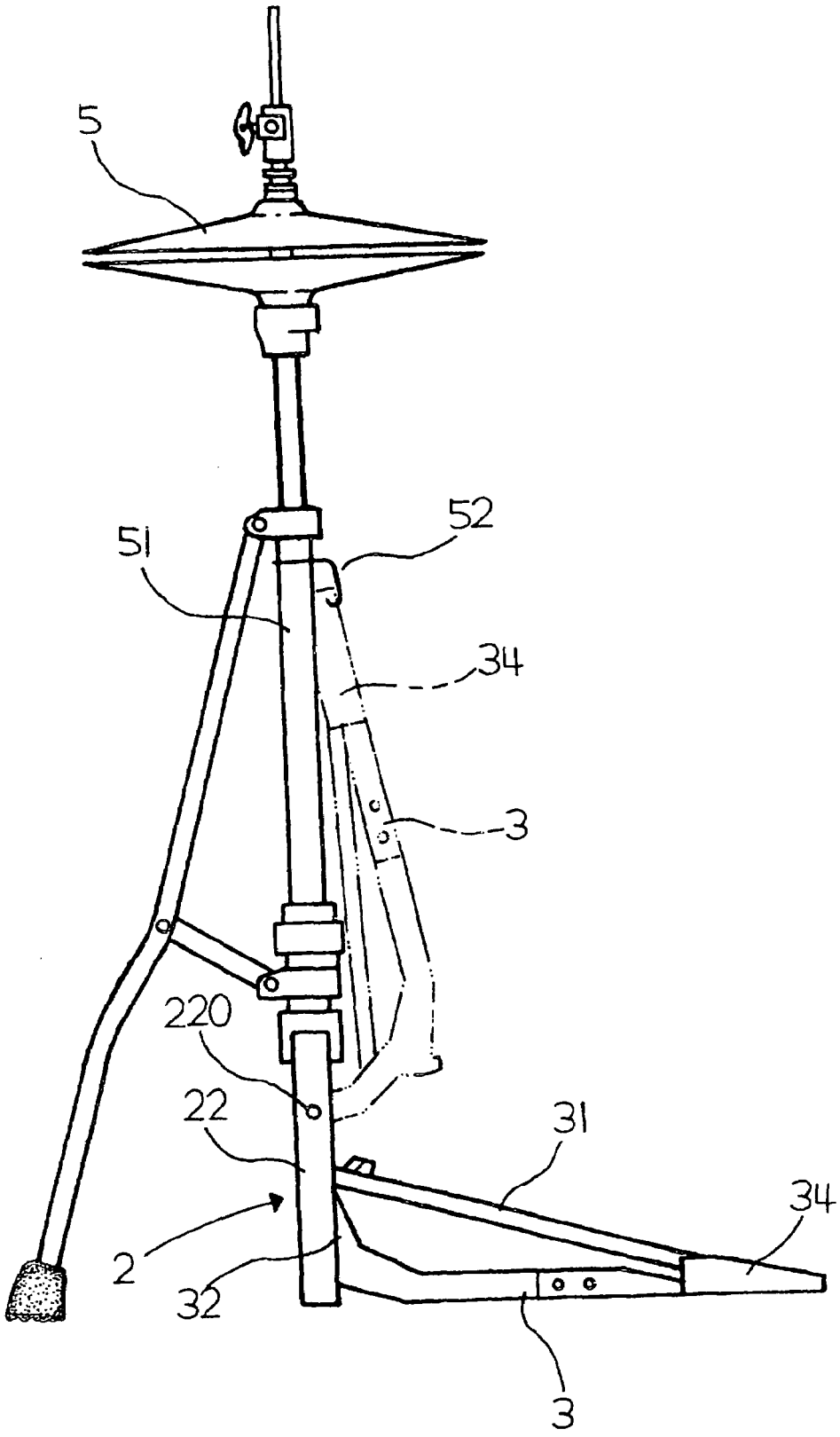
FIG. 5 is a plan view showing the pedal stand for a support stand.
Figure 6:
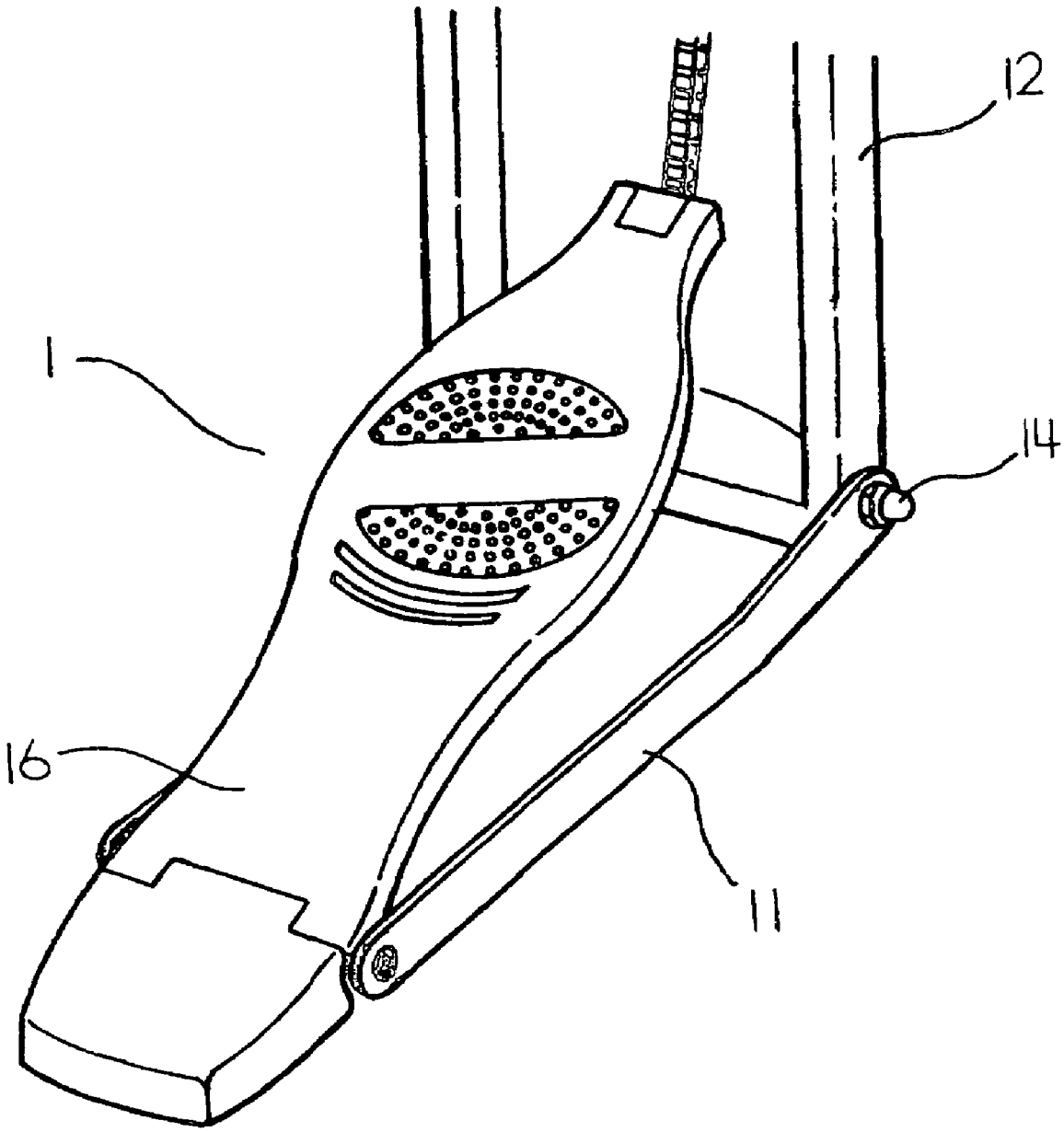
FIG .6 PRIOR ART
FIG. 6 is a partially perspective view of a conventional pedal stand in accordance with the prior art.

Referring to FIG. 5 with reference to FIGS. 1-4, when the pedal stand is mounted on a support stand 51, the main frame 2 is mounted on a lower portion of the support stand 51. The support stand 51 has an upper portion provided with a cymbal 5 and a mediate portion provided with a hanging hook 52.

In operation, referring to FIGS. 1-5, the elastic members 45 push the movable member 40 toward the support rack 3 so that each of the two catch portions 42 of the movable member 40 is locked onto the respective locking hook 33 of the support rack 3 at the normal state as shown in FIG. 3. Thus, the support rack 3 is locked by the locking device 4, so that the support rack 3 is not pivotable relative to the main frame 2.

When the push button 41 is pushed downward toward the movable member 40, the elastic members 45 are compressed, and the movable member 40 is moved away from the support rack 3 so that each of the two catch portions 42 of the movable member 40 is detached from the respective locking hook 33 of the support rack 3 as shown in FIG. 4. Thus, the support rack 3 is unlocked from the locking device 4, so that the support rack 3 is pivotable relative to the main frame 2.

As shown in FIG. 5, when the support rack 3 is pivotable upward, the second end 34 of the support rack 3 is hooked by the hanging hook 52 of the support stand 51, so that the pedal stand is folded onto the support stand 51.

After the force applied on the push button 41 is removed, the elastic members 45 push the movable member 40 toward the support rack 3 so that the movable member 40 is returned to the normal state. Thus, when the support rack 3 is pivotable downward toward the movable member 40, each of the locking hooks 33 of the support rack 3 is guided by the guide ramp 421 of the respective catch portion 42 of the movable member 40 and extended into and locked by the limit ramp 422 of the respective catch portion 42 of the movable member 40, so that the support rack 3 is locked by the locking device 4 again and is not pivotable relative to the main frame 2. Thus, the pedal stand is disposed at an expanded state.

Accordingly, when the push button 41 is pushed downward, the support rack 3 is unlocked from the locking device 4 and is pivotable relative to the main frame 2 to fold the pedal stand, so that the pedal stand is folded easily and quickly. In addition, the user only needs to push the push button 41 to fold the pedal stand, so that the pedal stand is folded in an energy-saving manner, thereby facilitating the user folding the pedal stand. Further, each of the catch portions 42 of the movable member 40 is locked onto the respective locking hook 33 of the support rack 3 at the normal state, so that the support rack 3 is locked by the locking device 4 closely and exactly, and the pedal stand is positioned rigidly and stably.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

The invention claimed is:

1. A pedal stand, comprising:

a main frame;

a support rack foldably mounted on the main frame;

a pedal pivotally mounted on the support rack;

a locking device mounted between the main frame and the support rack to detachably lock the support rack on the main frame;

wherein the main frame includes an upright support portion and a horizontal fixing portion mounted on a lower portion of the support portion;

wherein the fixing portion of the main frame has two sides each formed with a breach, the support rack has a mediate portion formed with two locking hooks each movably mounted in the respective breach of the fixing portion of the main frame, and the locking device includes a movable member movably mounted in the fixing portion of the main frame and formed with two protruding catch portions each detachably locked onto the respective locking hook of the support rack.

2. The pedal stand in accordance with claim 1, wherein the locking device is operable between a first position where the support rack is locked by the locking device, so that the support rack is not pivotable relative to the main frame and a second position where the support rack is unlocked from the locking device, so that the support rack is pivotable relative to the main frame.

3. The pedal stand in accordance with claim 1, wherein the breach is located at a connection of the fixing portion and the support portion.

4. The pedal stand in accordance with claim 1, wherein the locking device further includes a push button mounted on a first side of the movable member and protruded outwardly from the fixing portion of the main frame.

5. The pedal stand in accordance with claim 4, wherein the locking device further includes two fastening bolts each extended through the movable member and the fixing portion of the main frame, and two elastic members each mounted on the respective fastening bolts and each biased between the respective fastening bolts and a second side of the movable member to push the movable member toward the top of the fixing portion of the main frame and the support rack so that each of the two catch portions of the movable member is locked onto the respective locking hook of the support rack at a normal state.

6. The pedal stand in accordance with claim 1, wherein each of the two catch portions of the movable member has a first side formed with a limit ramp rested on the respective locking hook of the support rack and a second side formed with a guide ramp juxtaposed to the limit ramp.

7. The pedal stand in accordance with claim 6, wherein the limit ramp of each of the two catch portions of the movable member has an oblique direction facing that of the respective locking hook of the support rack.

8. The pedal stand in accordance with claim 6, wherein the guide ramp of each of the two catch portions of the movable member has an oblique direction different from that of the limit ramp.

9. The pedal stand in accordance with claim 6, wherein the guide ramp of each of the two catch portions of the movable member has an inclined angle smaller than that of the limit ramp.

10. The pedal stand in accordance with claim 1, wherein the support rack has a substantially L-shaped cross-sectional profile.

11. The pedal stand in accordance with claim 1, wherein the support rack has a first end pivotally mounted on the support portion of the main frame and a second end for pivoting the pedal.

12. The pedal stand in accordance with claim 11, wherein the first end of the support rack is pivotally mounted on the support portion of the main frame by two screw members.

13. The pedal stand in accordance with claim 12, wherein the support portion of the main frame is formed with two pivot holes to allow passage of the respective screw member.

14. The pedal stand in accordance with claim 4, wherein the fixing portion of the main frame has a top having a mediate portion formed with a through hole, and the push button of the locking device is protruded outwardly from the through hole of the fixing portion of the main frame.

15. The pedal stand in accordance with claim 1, wherein the fixing portion of the main frame has a hollow inside.

16. The pedal stand in accordance with claim 11, wherein the main frame is mounted on a lower portion of a support stand which has a mediate portion provided with a hanging hook.

17. The pedal stand in accordance with claim 16, wherein when the support rack is pivotable upward, the second end of the support rack is hooked by the hanging hook of the support stand.

18. The pedal stand in accordance with claim 5, wherein when the push button is pushed downward toward the movable member, the elastic members are compressed, and the movable member is moved away from the support rack so that each of the two catch portions of the movable member is detached from the respective locking hook of the support rack.

* * * * *